US010994759B2

(12) United States Patent
Bhatti et al.

(10) Patent No.: US 10,994,759 B2
(45) Date of Patent: May 4, 2021

(54) SYSTEM AND METHOD FOR PROVIDING INFORMATION TO AN INFORMATION SYSTEM IN A VEHICLE

(71) Applicant: TELEVIC RAIL NV, Izegem (BE)

(72) Inventors: Jabran Bhatti, Ostend (BE); Dirk Van Den Wouwer, Melsele (BE)

(73) Assignee: Televic Rail NV, Izegem (BE)

( * ) Notice: Subject to any disclaimer, the term of this patent is extended or adjusted under 35 U.S.C. 154(b) by 203 days.

(21) Appl. No.: 16/064,442

(22) PCT Filed: Dec. 22, 2016

(86) PCT No.: PCT/EP2016/082350
§ 371 (c)(1),
(2) Date: Jun. 20, 2018

(87) PCT Pub. No.: WO2017/109056
PCT Pub. Date: Jun. 29, 2017

(65) Prior Publication Data

US 2019/0002001 A1 Jan. 3, 2019

(30) Foreign Application Priority Data

Dec. 22, 2015 (EP) ..... 15202199

(51) Int. Cl.
*B61L 15/00* (2006.01)
*B61L 25/02* (2006.01)
*B61L 27/00* (2006.01)

(52) U.S. Cl.
CPC ..... *B61L 15/009* (2013.01); *B61L 15/0072* (2013.01); *B61L 25/021* (2013.01); (Continued)

(58) Field of Classification Search
CPC ..... B61L 15/009
See application file for complete search history.

(56) References Cited

U.S. PATENT DOCUMENTS 4,456,997 A * 6/1984 Spitza ..... H04L 1/0061 714/821
6,666,411 B1 * 12/2003 Hart ..... B61L 27/0038 246/1 C (Continued)

FOREIGN PATENT DOCUMENTS

CN 102211595 A 10/2011
CN 204355078 U 5/2015

(Continued)

OTHER PUBLICATIONS

NPL, Michigan Scientific Corporation, (https://www.michsci.com/products/instrumentation-assemblies/wheel-pulse-transducer) (downloaded on Jan. 13, 2021).*

(Continued)

*Primary Examiner* — Jean Paul Cass

(57) ABSTRACT

The invention pertains to a system for providing information to an information system in a vehicle, comprising: a communication interface (210) to communicate with a server (299) residing outside the vehicle (200); data storage means (220) to temporarily store data received from the server via the communication interface; data gathering means (230) to obtain information about a current situation or event independently of the server; an information system (100) to provide information services to crew and/or passengers or to control systems of the vehicle; and a processor (240). The processor is configured to: detect whether the communication interface is operational, if the communication interface is operational, provide data received from the communication interface to the information system; otherwise, provide data retrieved from the data storage means and adapted on the basis of information obtained from the data gathering means to the information system.

20 Claims, 3 Drawing Sheets

(52) U.S. Cl.
CPC ..... *B61L 25/025* (2013.01); *B61L 25/026* (2013.01); *B61L 27/0022* (2013.01); *B61L 2205/04* (2013.01)

(56) References Cited

U.S. PATENT DOCUMENTS 6,836,221 B1 * 12/2004 Boddie ..... B61L 29/246 246/125
7,099,754 B2 * 8/2006 Sugita ..... B61L 23/14 246/14
7,182,298 B2 * 2/2007 Fischer ..... B61L 23/00 246/167 R
7,201,350 B2 * 4/2007 Sugita ..... B61L 3/125 246/122 R
7,269,487 B2 * 9/2007 Watanabe ..... B61L 1/18 246/122 R
7,469,767 B2 * 12/2008 Jasem ..... B60K 28/04 180/170
7,548,032 B2 * 6/2009 Alton, Jr. ..... B60L 3/102 246/167 R
7,756,613 B2 * 7/2010 Katsuta ..... B61L 11/08 701/19
7,832,691 B2 * 11/2010 Reibeling ..... B61L 29/32 246/125
7,890,223 B1 * 2/2011 Young ..... B61L 1/16 701/19
8,452,466 B2 * 5/2013 Kiss ..... B61L 17/02 701/19
8,725,405 B2 * 5/2014 Steffen, II ..... B61L 29/226 701/400
8,892,276 B1 * 11/2014 Young ..... A63H 19/16 701/19
8,988,251 B2 * 3/2015 Clements ..... B61L 3/125 340/933
9,043,131 B2 * 5/2015 Carlson ..... B61L 23/06 701/301
9,085,310 B2 * 7/2015 McKillican ..... G01S 13/876
9,308,926 B2 * 4/2016 King ..... B61C 15/12
9,478,142 B2 * 10/2016 Tonguz ..... B61L 27/04
9,499,185 B2 * 11/2016 Green ..... B61L 25/04
10,507,854 B2 * 12/2019 DeJarnatt ..... B61L 29/32
2004/0260455 A1 * 12/2004 Dort ..... G08G 1/096758 701/117
2008/0195265 A1 * 8/2008 Searle ..... B61L 15/0081 701/19
2009/0173839 A1 * 7/2009 Groeneweg ..... B61L 23/042 246/15
2012/0116616 A1 * 5/2012 Morris ..... B61L 15/0054 701/19
2014/0180495 A1 6/2014 Marafioti et al.
2018/0339703 A1 * 11/2018 Nix ..... B60W 10/18
2019/0002001 A1 * 1/2019 Bhatti ..... B61L 15/0072

FOREIGN PATENT DOCUMENTS

DE 19544158 A1 5/1997
GB 201313505 9/2013
GB 2516663 A 2/2015
WO WO-2015014638 A1 * 2/2015 ..... B61L 25/021

OTHER PUBLICATIONS

Office Action from Chinese Patent Application No. 201680074987.9, dated Dec. 18, 2019.
Extended European Search Report from European Patent Application No. 15202199.4 (filed Dec. 22, 2015), dated Oct. 14, 2016.
International Search Report and Written Opinion in PCT Application No. PCT/EP2016/082350 (filed Dec. 22, 2016), dated Apr. 28, 2017.

* cited by examiner

SYSTEM AND METHOD FOR PROVIDING INFORMATION TO AN INFORMATION SYSTEM IN A VEHICLE

FIELD OF THE INVENTION

The present invention pertains to the field of information systems for passenger vehicles, such as trains, trams, buses, ferries, and the like.

BACKGROUND

Modern information systems used in passenger vehicles are used to display a variety of information that is of interest to the passengers, such as the next scheduled stop, the scheduled and estimated time of arrival at subsequent stops, real-time journey information, the time of day, the vehicle's speed, etc., or to the crew.

The relevant information is usually obtained from a server residing outside the vehicle, also referred to as a "wayside" server.

When items of information to be displayed are unavailable due to an interruption in the connection to the wayside server, the information system may cause the display system to display empty fields, error messages, or even meaningless signs, while other information that is available and relevant may not be displayed correctly. This may be confusing and annoying to intended recipients of the information, who fail to receive the information that they rely on.

Accordingly, there is a need for information systems and methods that at least partially overcome these problems.

SUMMARY

According to an aspect of the present invention, there is provided a system for providing information to an information system in a vehicle, the system comprising a communication interface adapted to communicate with a server residing outside the vehicle; data storage means configured to temporarily store data received from the server via the communication interface; data gathering means adapted to obtain information about a current situation or event independently of the server; an information system arranged to provide information services to crew and/or passengers or to control systems of the vehicle; and a processor, operatively connected to the communication interface, the data storage means, and the data gathering means, the processor being configured to provide information to the information system; wherein the processor is further configured to: detect whether the communication interface is operationally communicating with the server, if the communication interface is operational, provide data received from the communication interface as the information to the information system; and if the communication interface is not operational, provide data retrieved from the data storage means and adapted on the basis of information obtained from the data gathering means as the information to the information system. The data gathering means comprises at least one sensor arranged to sense wheel pulses, and the processor is configured to determine a current speed and/or a current location on the basis of the wheel pulses.

The term "current situation or event" is used to denote any situation or event that is relevant to the operation of the vehicle, the comfort of its passengers, the services offered to these passengers, and the like.

The present invention is based on the insight of the inventors that by providing a loose coupling between the information system onboard the vehicle and the wayside server, reliance on outdated or missing information can be avoided. The present invention is further based on the insight of the inventors that when connectivity to the wayside server is lost, cached data may still be relevant, if it can be brought up-to-date by means of other information that is available in the vehicle. Thus, rather than relying on merely cached data with the risk of using outdated information, the cached data is combined with data from on-board data gathering means such as sensors.

It is a further advantage of the invention that any data the relevance of which depends on the present location and/or speed of the vehicle, and which would normally be provided to the vehicle's information system depending on those parameters, can be selected from the local data storage on the basis of up-to-date location and/or speed information.

In an embodiment of the system according to the present invention, the data gathering means comprises a Global Positioning System receiver arranged to determine a current location of said vehicle.

It is an advantage of this embodiment that any data the relevance of which depends on the present location of the vehicle, and which would normally be provided to the vehicle's information system as certain locations are reached, can be selected from the local data storage on the basis of up-to-date location information.

In an embodiment of the system according to the present invention, the data gathering means comprises at least one sensor arranged to determine current weather conditions.

It is an advantage of this embodiment that stored arrival schedules and connection opportunities can be updated based on expected delays that correlate with certain severe weather conditions.

In an embodiment of the system according to the present invention, the data gathering means comprises means to retrieve locally generated information about the current situation or event.

It is an advantage of this embodiment that information obtained on board the vehicle can be used to appropriately update the stored information, optionally by means of an intervention by a crew member.

In an embodiment of the system according to the present invention, said information system comprises an output system for outputting messages in a passenger compartment of said vehicle.

Messages may be conveyed to the passengers or crew members in the vehicle by means of a display system or a public-address audio system coupled to appropriate text-to-speech conversion means.

In an embodiment of the system according to the present invention, the data gathering means further comprises a receiver for receiving railway beacon signals.

The term railway beacon is used herein to refer to an electronic beacon or transponder placed between the rails of a railway as part of an automatic train protection (ATP) system, also known in the art as a "balise". Such a balise typically has no independent power source, but is capable of operating on the radio-frequency energy received from a corresponding device (a "Balise Transmission Module") of a passing train. The transmissions from a balise typically include the location of the balise and information about the geometry of the line and any speed restrictions.

It is an advantage of this embodiment that the system can determine the location of the vehicle, in particular a railway vehicle such as a train, more accurately. Thus, any data the relevance of which depends on the present location of the vehicle, and which would normally be provided to the vehicle's information system as certain locations are reached, can be selected from the local data storage on the basis of up-to-date location information.

According to an aspect of the present invention, there is provided a passenger vehicle comprising the system as described above.

According to an aspect of the present invention, there is provided a method for providing information to an information system in a vehicle, said vehicle being equipped with a communication interface adapted to communicate with a server residing outside said vehicle and with data storage means configured to temporarily store data received from said server via said communication interface, said method comprising: obtaining information about a current situation or event independently of said server; detecting whether said communication interface is operationally communicating with said server, if said communication interface is operational, providing data received from said communication interface as said information to said information system; and if said communication interface is not operational, providing data retrieved from said data storage means and adapted on the basis of said information obtained from said data gathering means as said information to said information system.

In an embodiment of the method according to the present invention, the data gathering means further comprises a receiver for receiving railway beacon signals, and the processor is further configured to determine a current speed and/or a current location on the basis of said railway beacon signals.

According to an aspect of the present invention, there is provided a computer program product comprising code means configured to cause a processor to carry out the steps of the method described above.

The technical effects and advantages of embodiments of the passenger vehicle, the method and the computer program product according to the present invention correspond, mutatis mutandis, to those of the corresponding embodiments of the vehicle according to the present invention.

BRIEF DESCRIPTION OF THE FIGURES

These and other features and advantages of embodiments of the present invention will now be described in more detail with reference to the attached drawings, in which.

DESCRIPTION OF EMBODIMENTS

Figure 1:
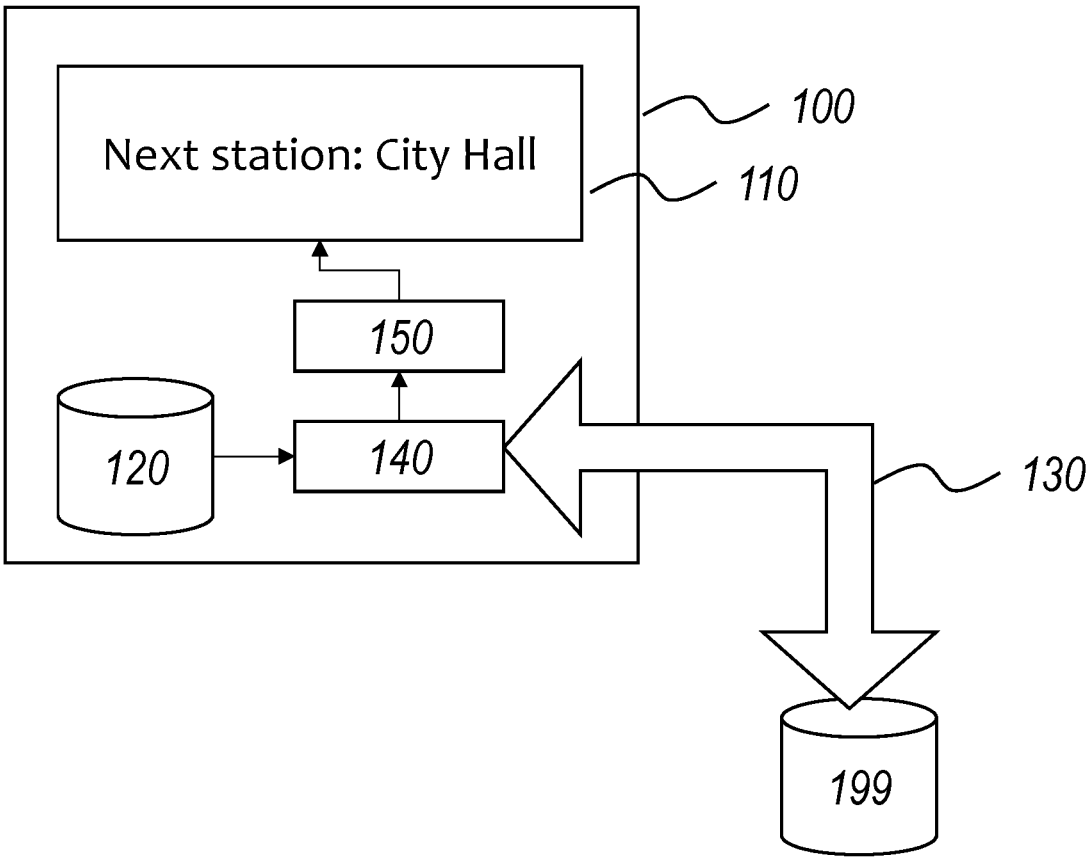
FIG. 1 schematically illustrates a display system which may be part of an embodiment of the vehicle according to the present invention.

FIG. 1 schematically illustrates a display system 100 for displaying messages in a passenger compartment of a vehicle (not shown). The system 100 may comprise a display surface 110, which may for example be a TFT display, an LCD display, or a LED display. Additionally or alternatively, the system 100 may comprise audio outputting means to convey messages to the passengers.

The system 100 is further capable of receiving information from an information system 199, co-located with the system 100 (internally in the same housing, or otherwise present in the same vehicle). Along with the information that is useful for display in the passenger compartment, associated metadata may be received.

Such metadata may include, without limitation, one or more of an expiry time of the received information, a source of said received information (e.g. an up-to-date on-line source or a cache), and a condition to be met for said received information to be displayed (e.g. with respect to location, time-of-day, or the like). In certain applications, such as advertising, it may be useful to make the displaying of certain messages conditional on the profile of the passengers that are present in the vehicle; in such cases, the metadata may for example include an indication of the profiles which must be present for the message to be displayed.

Processing means 140 are provided to evaluate the retrieved information, in particular the metadata, if present. The processing means 140 may be implemented in dedicated hardware (e.g., ASIC), configurable hardware (e.g., FPGA), programmable components (e.g., a DSP or general purpose processor with appropriate software), or any combination thereof. The same component(s) may also include other functions.

Formatting means 150, which may be implemented as part of the processing means 140 are configured to format the retrieved information in accordance with an appropriate template for displaying on the display surface, or to perform a text-to-speech conversion for conveying the message by audio means. The formatted or converted information is supplied to the outputting means over a suitable interface in accordance with the signal format required by the latter for correct operation.

Figure 2:
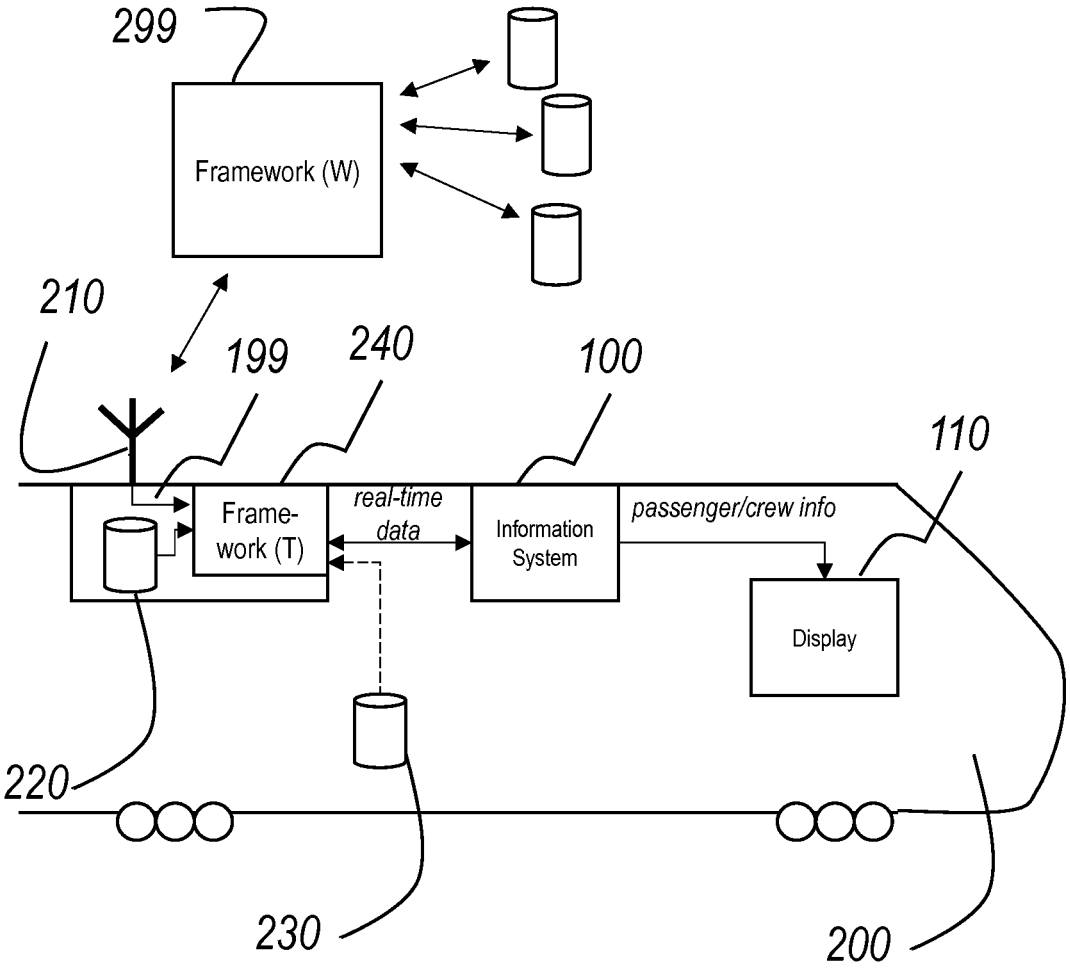
FIG. 2 schematically illustrates an embodiment of the vehicle according to the present invention.

FIG. 2 illustrates a system for providing information to an information system 100 in a vehicle 200, according to an embodiment of the present invention. The illustrated system comprises a communication interface 210 adapted to communicate with a server 299 residing outside the vehicle 200, i.e. on the wayside (W). Given the mobile nature of the vehicle, this communication interface must be adapted for wireless communication, preferably mobile communication, e.g. by adhering to a mobile data communication standard such as GSM, GPRS, 3G, LTE, and the like. The illustrated system further includes data storage means 220 configured to temporarily store data received from the server 299 via the communication interface 210, i.e. a data storage functioning as a local cache.

Data gathering means 230 are adapted to obtain information about a current situation or event independently of the server. The data gathering means 230 includes one or more sensors arranged to sense wheel pulses (wherein the processor is configured to determine a current speed and/or a current location on the basis of the wheel pulses). The data gathering means 230 may further include a receiver for receiving railway beacon signals, in particular location signals transmitted by balises arranged between the rails. The data gathering means 230 may further include one or more of a Global Positioning System receiver arranged to determine a current location of the vehicle, means for determining the vehicle's speed and/or location on the basis of real-time images captured by cameras arranged on the vehicle, and other similar arrangements for determining the vehicle's location.

The data gathering means 230 may include one or more sensors arranged to determine current weather conditions, and/or means to retrieve locally generated information about the current situation or event.

The data gathering means 230 may comprise an interface to exchange information with mobile devices carried by passengers or crew members inside the vehicle, and which may have a wide variety of sensors integrated in them.

The system further comprises an information system 100 arranged to provide information services to crew and/or passengers or to control systems of the vehicle, which may in particular be an information system 100 as described in the context of FIG. 1. A processor 240, operatively connected to the communication interface 210, the data storage means 220, and the data gathering means 230, is configured to provide information to the information system 100.

The processor 240 is configured to detect whether the communication interface 210 is operationally communicating with the server 299. The determination whether the communication interface 210 is operational or not, may include awaiting the expiry of a time-out, the carrying out of a predetermined number of communication attempts, and other steps known to the person skilled in the art for establishing or maintaining a communication link. If the communication interface 210 is operational, the processor 240 provides data received from the communication interface 210 to the information system 100. If the communication interface 210 is not operational, the processor 240 provides data retrieved from the data storage means 220 and adapted on the basis of information obtained from the data gathering means 230 to the information system 100. The adaptation step may further take into account historical or statistical data about the vehicle and its route.

The processor 240 may be implemented in dedicated hardware (e.g., ASIC), configurable hardware (e.g., FPGA), programmable components (e.g., a DSP or general purpose processor with appropriate software), or any combination thereof. The same component(s) may also include other functions, such as for example the processing means 140 of the information server 100.

Figure 3:
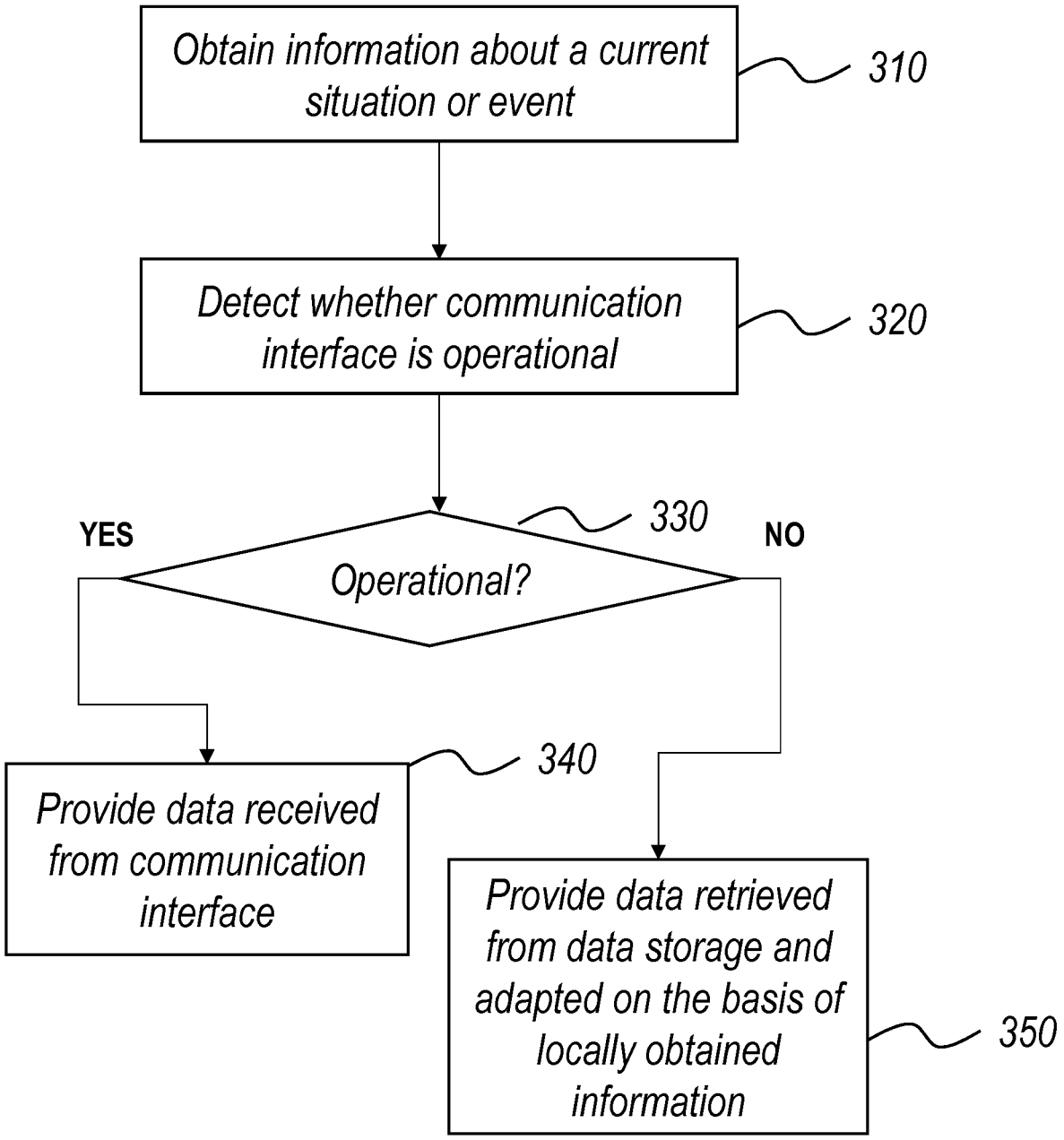
FIG. 3 provides a flow chart of an embodiment of the method according to the present invention.

FIG. 3 provides a flow chart of an embodiment of the method according to the present invention. The method applies to a system as generally described with reference to FIG. 2, and all optional details of said system apply mutatis mutandis to embodiments of the method according to the present invention.

In a first step, the method comprises obtaining 310 information about a current situation or event independently of the server. This obtaining 310 is carried out by means of the local data gathering means 230 provided in the system. In a next step, typically carried out by a processor 240, the method comprises detecting 320 whether the communication interface is operationally communicating with the server. If the communication interface is operational 330, data received from the communication interface is provided 340 to the information system to be conveyed to the passengers and/or crew through the appropriate outputting means (display or audio). If, on the other hand, the communication interface is not operational 330, data retrieved from the data storage means and adapted on the basis of information obtained from the data gathering means is provided 350 to the information system to be conveyed to the passengers and/or crew through the appropriate outputting means (display or audio).

The present invention also relates to a computer program product comprising code means configured to cause a processor to carry out the steps of the method described above. The computer program product may consist of the code means provided on a computer-readable medium, such as an optical, magnetic, or semiconductor-based storage medium.

The invention is further clarified by means of a use case. This use case describes the invention in the following scenario in which passenger information must be continuously provided in a train compartment during an interruption in the internet connection.

In this scenario, the train is traveling along a route with unreliable internet connectivity (e.g., through an area with limited 3G coverage).

The train is initially connected to the internet through a 3G network. The internet connection is used to periodically download real-time journey information: the current status of this journey and the status of connecting transport modes at the next calling point. The train is suffering a delay of fifteen minutes at the next calling point due to bad weather conditions.

The system described by this invention arranges and pushes the data to the on-board signage system. The data may be marked as 'live' indicating that the information was retrieved from the wayside. The system also keeps a record of each or a subset of the status updates received from the wayside through the internet connection (e.g., stores them in the local cache).

Next, the train enters an area with limited 3G coverage, and the internet connection is lost for a prolonged time period. The train is unable to receive status updates.

The system according to the present invention will notice the connection loss. In order to guarantee up-to-date passenger information on the on-board displays, it may compute an estimate of the current status of this journey and the status of connecting transport modes at the next calling point. To this end, the system takes into account the context of the train: the current location of the train and the data that was most recently received including the stored weather forecast.

An expected time of arrival is computed taking into account the current train location and the remaining trajectory, along with historically stored data for this journey. Connecting service at the next calling point is marked as risky for transport modes with running times that are affected by the bad weather conditions.

The system pushes the predicted status update data to the on-board signage system. The data may be marked as 'local' indicating that the information is an unconfirmed estimate.

While the invention has been described hereinabove with reference to specific embodiments, this was done to clarify and not to limit the invention. The skilled person will appreciate that various modifications and different combinations of disclosed features are possible without departing from the scope of the invention.

The invention claimed is:

1. A system for providing information to an information system in a vehicle, the system being aboard the vehicle and comprising:

a communication interface adapted to communicate with an external server, the external server residing outside said vehicle;

data storage means configured to temporarily store data received from said external server via said communication interface;

data gathering means adapted to obtain information about a current situation or event independently of said external server;

the information system, wherein the information system is arranged to provide information services to crew, to passengers, or to crew and passengers, or to control systems of said vehicle; and a processor, operatively connected to said communication interface, said data storage means, and said data gathering means, said processor being configured to provide information to said information system;

wherein said processor is further configured to:

detect whether said communication interface is operationally communicating with said external server, if said communication interface is operational, provide data received from said external server via said communication interface as said information to said information system; and if said communication interface is not operational, provide data retrieved from said data storage means and adapted on the basis of information obtained from said data gathering means as said information to said information system;

wherein said data gathering means comprises at least one sensor arranged to sense wheel pulses, said processor being configured to determine a current location on the basis of said wheel pulses.

2. The system according to claim 1, wherein said data gathering means further comprises a Global Positioning System receiver arranged to determine the current location of said vehicle.

3. The system according to claim 1, wherein said data gathering means comprises at least one sensor arranged to determine current weather conditions.

4. The system according to claim 1, wherein said data gathering means comprises means to retrieve locally generated information about said current situation or event.

5. The system according to claim 1, wherein said information system comprises an output system for outputting messages in a passenger compartment of said vehicle.

6. The system according to claim 1, wherein said data gathering means further comprises a receiver for receiving railway beacon signals.

7. A passenger vehicle comprising the system according to claim 1.

8. A method for providing information to an information system in a vehicle, said vehicle being equipped with a communication interface adapted to communicate with an external server residing outside said vehicle and with on-board data storage means configured to temporarily store data received from said external server via said communication interface, said method comprising:

obtaining information about a current situation or event using on-board data gathering means, independently of said external server;

detecting whether said communication interface is operationally communicating with said external server;

if said communication interface is operational, providing data received from said external server via said communication interface as said information to said information system;

if said communication interface is not operational, providing data retrieved from said data storage means and adapted on the basis of said information obtained from said on-board data gathering means as said information to said information system;

wherein obtaining information about the current situation or event using said on-board data gathering means comprises sensing wheel pulses, and determining a current location on the basis of said wheel pulses.

9. The method according to claim 8, wherein obtaining information about the current situation or event using said on-board data gathering means further comprises a receiver receiving railway beacon signals, and wherein determining the current location is on the basis of said received railway beacon signals.

10. A non-transitory computer program product comprising code means configured to cause a processor to carry out the steps of claim 8.

11. A non-transitory computer program product comprising code means configured to cause a processor to carry out the steps of claim 9.

12. The system according to claim 2, wherein said data gathering means comprises at least one sensor arranged to determine current weather conditions.

13. The system according to claim 2, wherein said data gathering means comprises means to retrieve locally generated information about said current situation or event.

14. The system according to claim 3, wherein said data gathering means comprises means to retrieve locally generated information about said current situation or event.

15. The system according to claim 2, wherein said information system comprises an output system for outputting messages in a passenger compartment of said vehicle.

16. The system according to claim 3, wherein said information system comprises an output system for outputting messages in a passenger compartment of said vehicle.

17. The system according to claim 4, wherein said information system comprises an output system for outputting messages in a passenger compartment of said vehicle.

18. The system according to claim 2, wherein said data gathering means further comprises a receiver for receiving railway beacon signals.

19. The system according to claim 3, wherein said data gathering means further comprises a receiver for receiving railway beacon signals.

20. The system according to claim 4, wherein said data gathering means further comprises a receiver for receiving railway beacon signals.

* * * * *